US007513404B2

(12) United States Patent
Shkolnikov et al.

(10) Patent No.: US 7,513,404 B2
(45) Date of Patent: Apr. 7, 2009

(54) DEPTH OF DRIVE CONTROL WITH LOAD TRANSFER FOR FASTENER DRIVER

(75) Inventors: Yury Shkolnikov, Glenview, IL (US); Anatoly Gosis, Palatine, IL (US); Tony Deieso, Wadsworth, IL (US)

(73) Assignee: Illinois Tool Works Inc., Glenview, IL (US)

( * ) Notice: Subject to any disclaimer, the term of this patent is extended or adjusted under 35 U.S.C. 154(b) by 125 days.

(21) Appl. No.: 11/786,939

(22) Filed: Apr. 13, 2007

(65) Prior Publication Data

US 2008/0251567 A1 Oct. 16, 2008

(51) Int. Cl.
*B25C 1/04* (2006.01)

(52) U.S. Cl. ..... 227/8; 227/130; 227/142

(58) Field of Classification Search ..... 227/8, 227/10, 130, 119, 142, 147
See application file for complete search history.

(56) References Cited

U.S. PATENT DOCUMENTS

| | | | | | |
|---|---|---|---|---|---|
| 3,774,293 | A | * | 11/1973 | Golsch | 29/432.1 |
| 4,227,637 | A | * | 10/1980 | Haytayan | 227/8 |
| 4,573,623 | A | * | 3/1986 | Sexton et al. | 227/66 |
| 4,778,094 | A | * | 10/1988 | Fishback | 227/66 |
| 5,205,457 | A | * | 4/1993 | Blomquist, Jr. | 227/66 |
| 5,320,268 | A | | 6/1994 | Shkolnikov et al. | |
| 5,484,094 | A | * | 1/1996 | Gupta | 227/8 |
| 5,649,661 | A | * | 7/1997 | Masuno et al. | 227/8 |
| 5,685,473 | A | * | 11/1997 | Shkolnikov et al. | 227/8 |
| 5,799,855 | A | * | 9/1998 | Veoukas et al. | 227/10 |
| 5,996,874 | A | * | 12/1999 | Fukushima et al. | 227/8 |
| 6,145,723 | A | * | 11/2000 | Gupta | 227/8 |
| 6,145,727 | A | * | 11/2000 | Mukoyama et al. | 227/130 |
| 6,186,386 | B1 | * | 2/2001 | Canlas et al. | 227/142 |
| 6,454,151 | B1 | * | 9/2002 | Wang-Kuan | 227/8 |
| 6,578,750 | B2 | * | 6/2003 | Kubo et al. | 227/142 |
| 6,695,192 | B1 | | 2/2004 | Kwok | |
| 6,776,322 | B2 | * | 8/2004 | Villela et al. | 227/142 |
| 6,783,044 | B2 | * | 8/2004 | Perra et al. | 227/8 |
| 6,789,718 | B2 | * | 9/2004 | Canlas et al. | 227/130 |
| 6,892,922 | B2 | | 5/2005 | Tucker et al. | |
| 7,255,256 | B2 | * | 8/2007 | McGee et al. | 227/8 |

* cited by examiner

*Primary Examiner*—Scott A. Smith
(74) *Attorney, Agent, or Firm*—Greer, Burns & Crain, Ltd.; Mark W. Croll; Christopher P. Rauch

(57) ABSTRACT

An adjustable depth of drive apparatus is provided for use on a fastener driving tool including a nosepiece defining a fastener passageway, and a driver blade reciprocating in the passageway for driving fasteners sequentially fed from a magazine into a workpiece. The depth of drive apparatus includes a depth of drive adjustment element being reciprocally movable relative to an end of the nosepiece, the depth of drive adjustment element defining a nosepiece chamber dimensioned for receiving the nosepiece and including a driver blade stop configured for receiving an end of the driver blade to terminate vertical driving motion of the driver blade.

20 Claims, 5 Drawing Sheets

DEPTH OF DRIVE CONTROL WITH LOAD TRANSFER FOR FASTENER DRIVER

BACKGROUND OF THE INVENTION

The present invention relates generally to fastener driving tools such as combustion powered tools, pneumatic tools, cordless framing tools and the like. More particularly, the present invention relates to improvements in a device which adjusts the depth of drive of the tool.

Such tools typically have a housing enclosing a power source, such as combustion, pneumatic, electric or powder, a trigger mechanism and a magazine storing a supply of fasteners for sequential driving. The power source includes a reciprocating driver blade which separates a forwardmost fastener from the magazine and drives it through a nosepiece into the workpiece. The nosepiece is also the conventional attachment point for the magazine and defines the entryway for fasteners from the magazine into a fastener passage where impact with the driver blade occurs, as well as subsequent transport into the workpiece.

One operational characteristic required in many types of fastener driving applications is the ability to predictably control fastener driving depth. For the sake of appearance, some trim applications require fasteners to be countersunk below the surface of the workpiece, others require the fasteners to be sunk flush with the surface of the workpiece, and some may require the fastener to stand off above the surface of the workpiece. Depth adjustment has been achieved in pneumatically powered and combustion powered tools through a tool controlling mechanism, referred to as a drive probe that is movable in relation to the nosepiece of the tool. The range of movement of the depth adjustment defines a range for fastener depth-of-drive. Similar depth of drive adjustment mechanisms are known for use in combustion type framing tools.

Besides trim applications, there are other instances where fastener driving depth is important, including but not limited to siding and wallboard installation. It has been found that fastener depth of drive varies significantly based on the tool power source as well as the characteristics of the workpiece or substrate. Improperly adjusted fastener driving tools leave fasteners incompletely driven into the workpiece, or cause dents or dimples to the workpiece through overdriving.

U.S. Pat. No. 5,320,268, incorporated by reference, discloses a powered fastener driving tool designed for creating a dimple in wallboard during the fastener driving process. A relatively large shoe-type workpiece contact element (WCE) includes a reciprocating dimpler which is engaged by the driver blade to create a dimple as the fastener is being driven. In this unit, the dimpler is a separate component and is spring biased relative to the nosepiece as well as to the WCE. This construction is relatively complex, and is not always required for tool applications where flush driving of fasteners is desired, as in the installation of siding or other applications. In such applications, the creation of dimples in the workpiece is considered counterproductive and is to be avoided.

In U.S. Pat. No. 6,695,192, incorporated by reference, a fastener driver is disclosed wherein the WCE is connected to and movable with the internal bumper that engages the reciprocating piston. In this tool, impact on the workpiece is regulated by the independent WCE movement relative to the nosepiece. This system is effective in absorbing shock generated in fastener driving to reduce unwanted "second strike" or workpiece damage caused by tool recoil, as well as user difficulty in accurately maintaining the tool in position during fastener driving. However, the configuration of the WCE in this unit is considered relatively complicated. Also, it has been found that a drawback of providing relatively large WCE's is that in some applications they obscure the workpiece, thus interfering with accuracy in fastener driving.

Thus, there is a need for an improved depth of drive mechanism for a fastener driving tool in which combustion cycle impact forces on the workpiece are reduced. There is also a need for such an improved depth of drive mechanism which is less complicated than prior art designs. In addition, there is a need for an improved depth of drive mechanism for a fastener driving tool which facilitates user visibility of the workpiece.

SUMMARY OF THE INVENTION

The above-listed needs are met or excluded by the present depth of drive device for use on a fastener driving tool, such as a combustion type framing tool or the like. A relatively simple configuration includes only the depth of drive adjustment element having a tapered internal bore which matingly accommodates a tapered end of the driver blade. The depth of drive adjustment element is vertically reciprocable relative to the nosepiece. A relatively broad-footed shoe is preferably adjustably secured to an end of the depth of drive adjustment element to vary the depth of drive and to distribute combustion-induced shock impacts. A locking device is preferably provided to releasably retain the shoe in position as well as to provide user notification of the position of the shoe relative to the depth of drive adjustment element . To enhance fastener driving accuracy, the shoe is preferably provided with a visibility enhancing "sight" portion.

More specifically, the present adjustable depth of drive apparatus is for use on a fastener driving tool including a nosepiece defining a fastener passageway, and a driver blade reciprocating in the passageway for driving fasteners sequentially fed from a magazine into a workpiece. The depth of drive apparatus includes a depth of drive adjustment element being reciprocally movable relative to an end of the nosepiece, the depth of drive adjustment element defining a nosepiece chamber dimensioned for receiving the nosepiece and including a driver blade stop configured for receiving an end of the driver blade to terminate vertical driving motion of the driver blade.

In another embodiment, a fastener driving tool includes a driver blade having a body with at least one longitudinal guide formation and a tapered driving end, a nosepiece defining a fastener passageway and configured for reciprocally receiving the driver blade, the passageway having at least one complementary rib slidably engaging the at least one guide formation. A depth of drive adjustment element is reciprocally movable relative to an end of the nosepiece, the depth of drive adjustment element defining a nosepiece chamber dimensioned for slidably receiving the nosepiece and including a driver blade stop configured for receiving the driver blade end to terminate vertical driving motion of the driver blade.

In yet another embodiment, a fastener driving tool includes a driver blade having a body with at least one longitudinal guide formation and a tapered driving end, —a nosepiece defining a fastener passageway and configured for reciprocally receiving the driver blade, the passageway having at least one complementary rib slidably engaging the at least one guide formation. A depth of drive adjustment element is reciprocally movable relative to an end of the nosepiece, the depth of drive adjustment element defining a nosepiece chamber dimensioned for receiving the nosepiece and including a driver blade stop configured for receiving the driver blade end to terminate vertical driving motion of the driver blade; and a shoe mounted to the depth of drive adjustment element for adjustment relative thereto for adjusting the depth of drive. The shoe is provided with a foot dimensioned for engaging the workpiece and a sight portion for facilitating visibility of the workpiece and locating a fastener driving location.

DESCRIPTION OF THE PREFERRED EMBODIMENT

Figure 1:
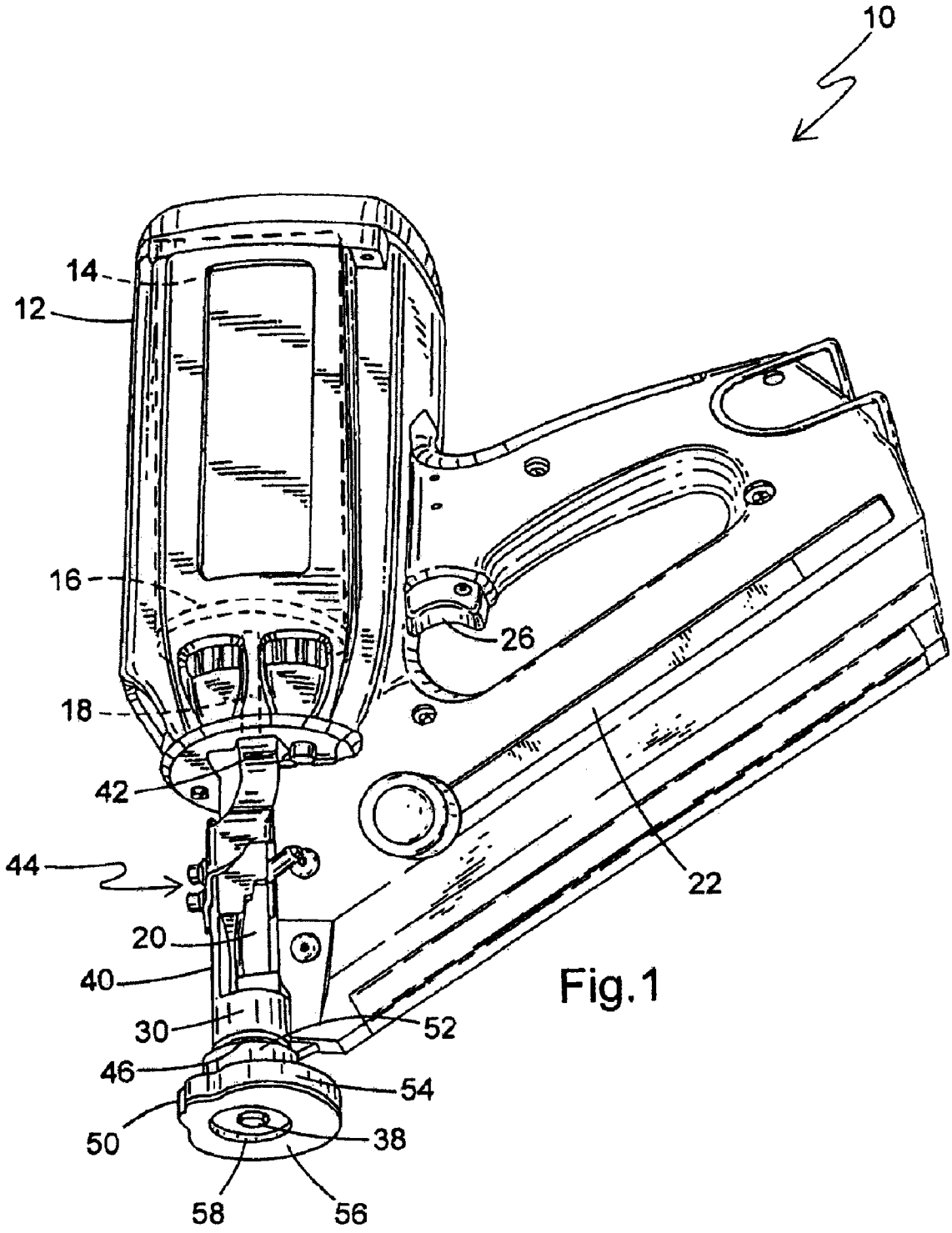
FIG. 1 is a perspective view of a fastener driver tool suitable for use with the present adjustable depth of drive device shown assembled and attached to the sleeve of a fastener driving tool.
Figure 2:
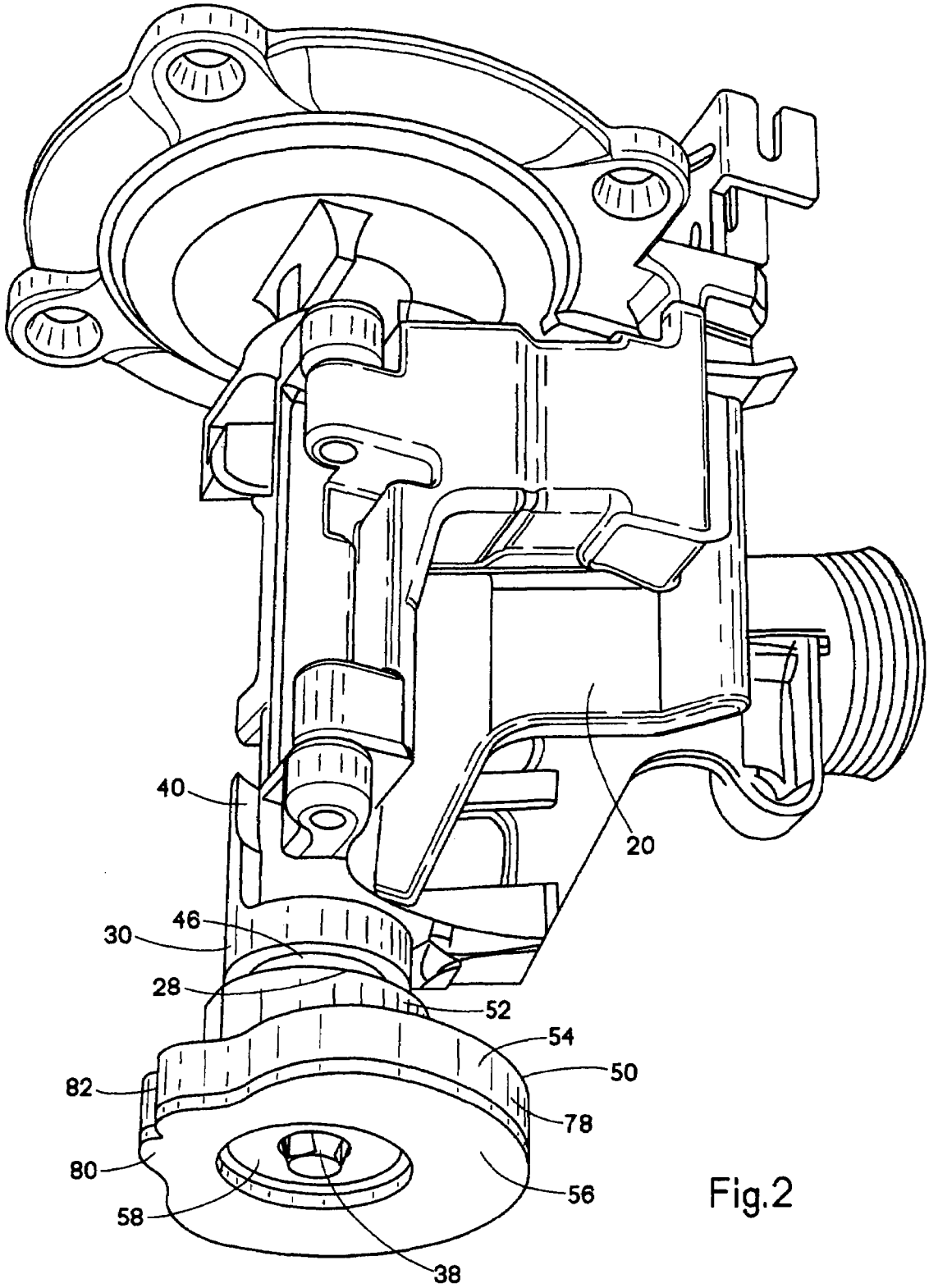
FIG. 2 is a fragmentary bottom perspective view of the present depth of drive apparatus shown assembled to a tool nosepiece.

As seen in FIGS. 1 and 2, a fastener driving tool suitable for use with the present improved depth of drive apparatus is generally designated 10, and while shown as a combustion powered tool or combustion nailer, it is understood that the present depth of drive apparatus may be used with other fastener driving tools, including but not limited to pneumatic, electric and powder activated tools. The tool 10 includes a housing 12 which encloses a power source 14 (shown hidden) including a reciprocating piston 16 having a driver blade 18 secured thereto for common movement relative to the power source.

Figure 3:
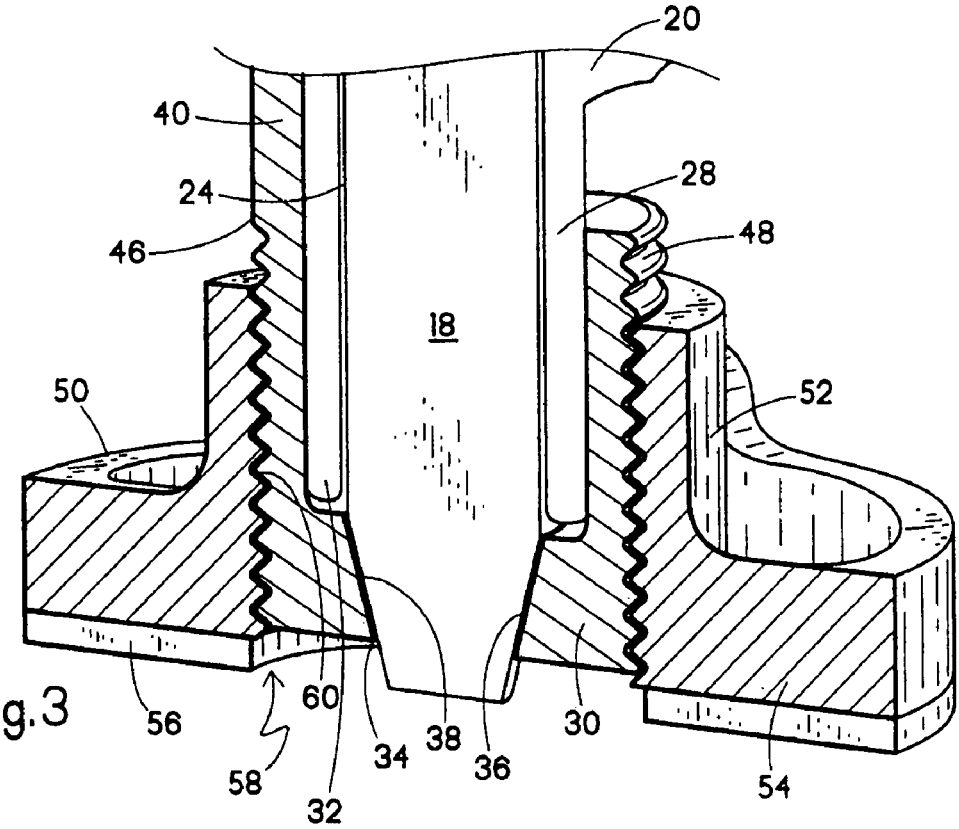
FIG. 3 is an enlarged, fragmentary vertical cross-section of the present depth of drive adjustment apparatus shown in a maximum depth position.
Figure 7:
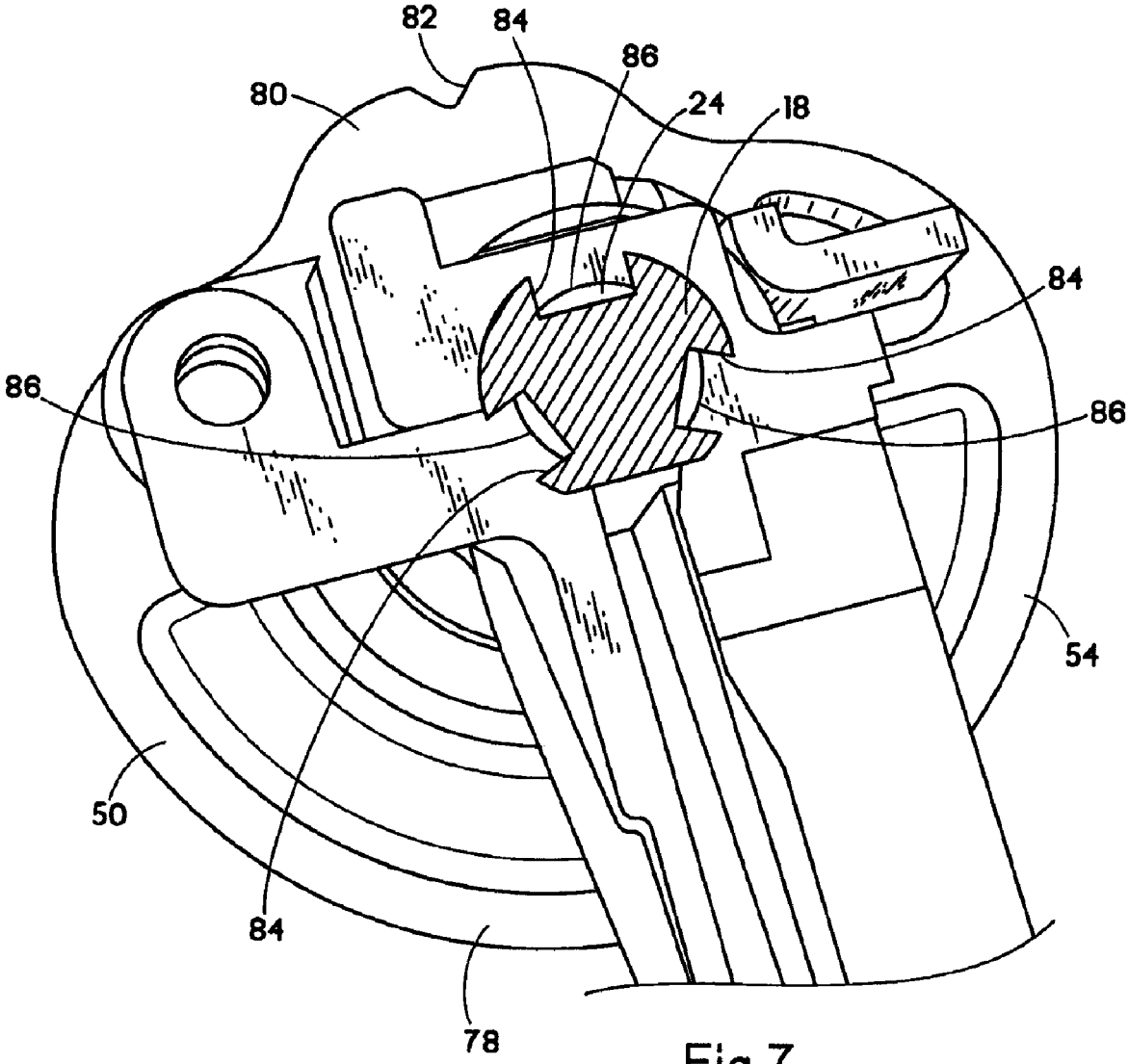
FIG. 7 is a plan view of the present nosepiece with the driver blade shown in section.

A nosepiece 20 is secured to a lower end of the power source 14 as is known in the art and provides an attachment point for a fastener magazine 22. Fasteners are fed sequentially into the nosepiece 20 where they are engaged by the driver blade 18 traveling down a fastener passageway 24 (FIGS. 3 and 7). The fasteners are driven into a workpiece or substrate after initiation of a power cycle, initiated in some tools by the operator actuating a trigger 26.

Figure 4:
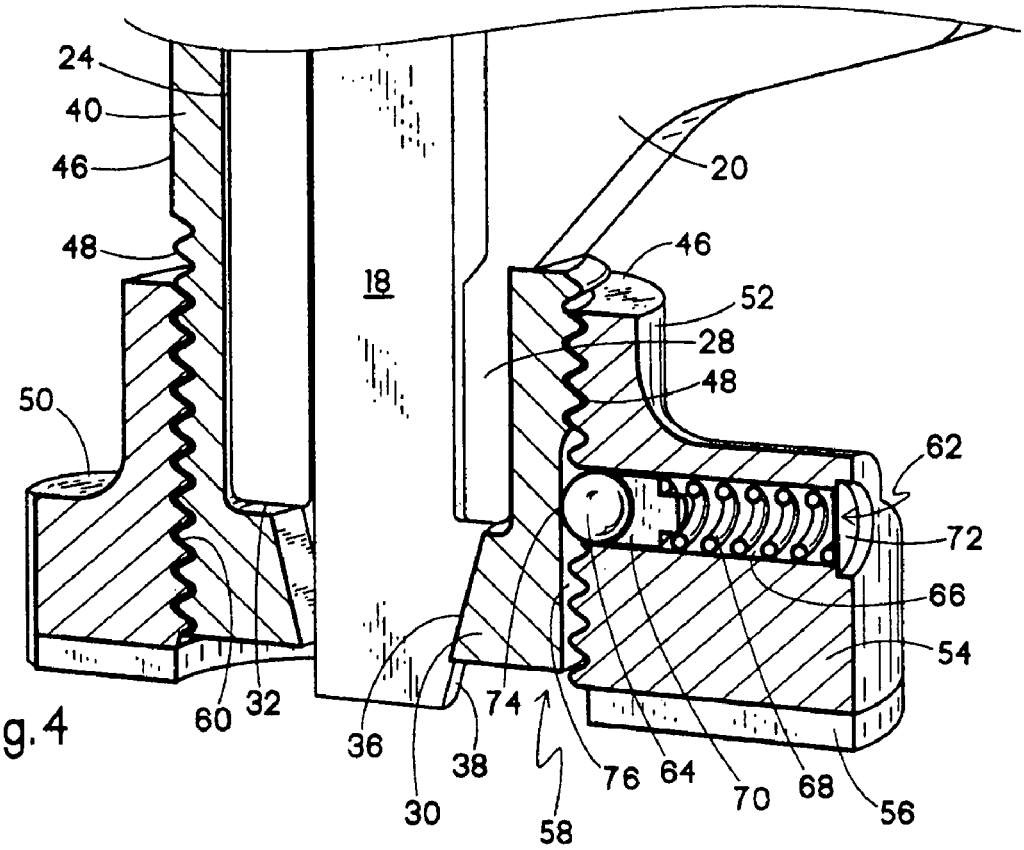
FIG. 4 is a vertical cross-section of the present depth of drive apparatus in the flush position and showing a locking mechanism.
Figure 5:
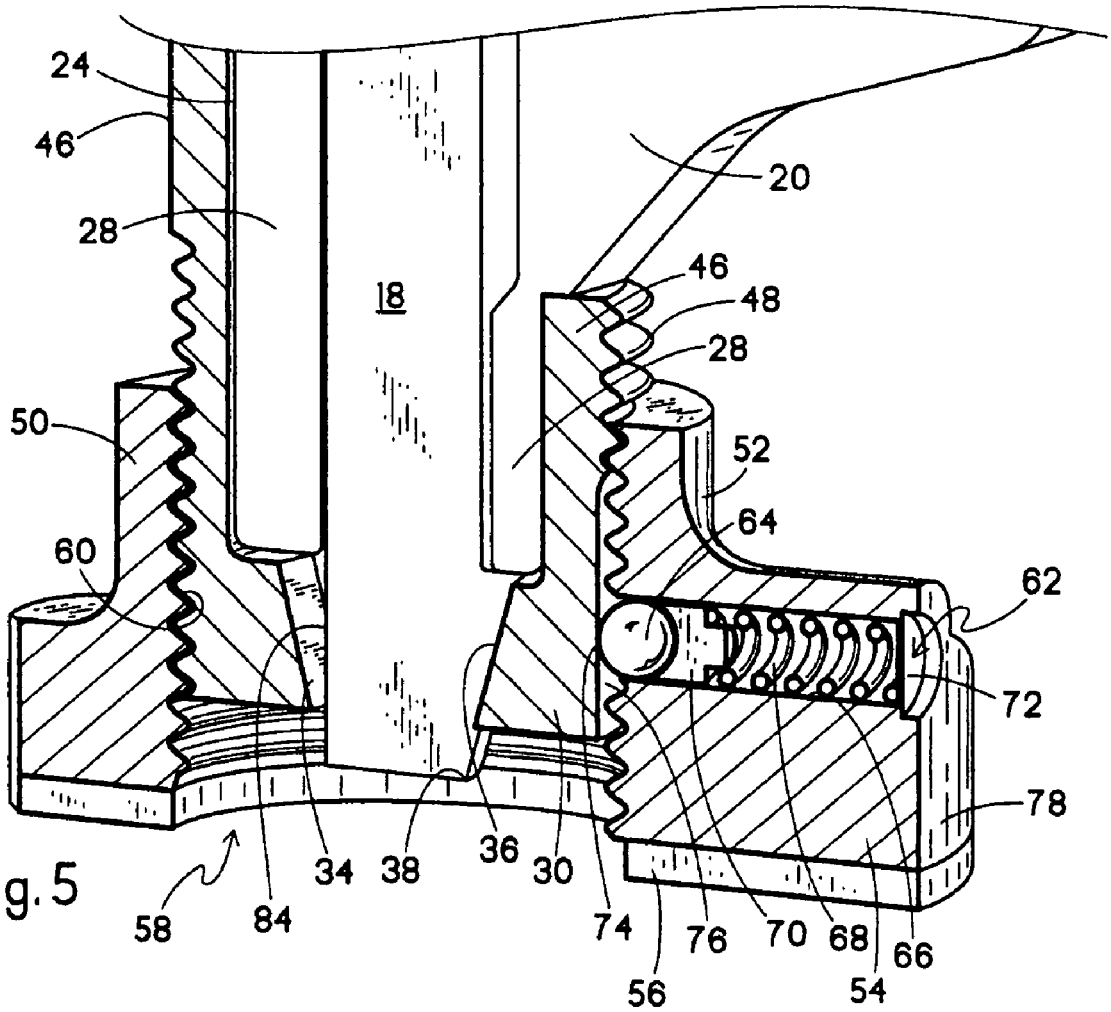
FIG. 5 is a vertical cross-section of the depth of drive apparatus of FIG. 4 shown in a raised or reduced depth position.

Referring now to FIGS. 3-5, at a lower end 28 of the nosepiece 20, a depth of drive adjustment element 30 is slidably engaged for reciprocal movement relative to the lower end 28. The depth of drive adjustment element 30 defines a nosepiece chamber 32 dimensioned for receiving the nosepiece end 28 and including an opening 34 in communication with the fastener passageway 24 in the nosepiece 20. The opening 34 defines a driver blade stop 36 configured for receiving an end 38 of the driver blade 18 for terminating vertical driving motion of the driver blade in the passageway 24. In the preferred embodiment, the driver blade end 38 is tapered, and the stop 36 is complementarily tapered for directly receiving the end of the blade 18 and also for deflecting forces generated by the impact of the driver blade against the stop due to fastener driving operation.

Opposite the opening 34, the depth of drive adjustment element 30 is provided with a link arm 40 which engages the power source 14, either directly or indirectly, as is known in the art. The link arm 40 is preferably provided in multiple components with an upper portion 42 being adjustable relative to the link arm 40 using a releasably lockable adjustment mechanism 44. As is well known in the art, the adjustment mechanism 44 (FIG. 1) may be a pair of threaded fasteners; however other such adjustment devices are contemplated. In the preferred embodiment, the depth of drive adjustment element 30 has an exterior surface 46 which is at least partially provided with threads 48 or other equivalent adjustment formation such as flutes, grooves, notches or the like.

A shoe generally designated 50 is preferably mounted to the depth of drive adjustment element 30 for coarse adjustment relative thereto for adjusting the depth of drive of fasteners driven down the passageway 24 by the driver blade 18. The adjustment mechanism 44 is considered more preferable for fine adjustment. Included on the shoe 50 is a shoe body 52 having a foot 54 constructed and arranged for engaging the workpiece or substrate, and preferably is provided with a resilient foot pad 56 to protect the substrate from damage and to dampen shock impact forces generated from fastener driving. A central bore 58 is defined by the body 52 and is dimensioned to receive the threaded exterior 46 of the depth of drive adjustment element 30. As such, a wall 60 of the central bore 58 is threaded to engage the threads 48. Threaded adjustment of the shoe 50 relative to the depth of drive adjustment element 30 determines the depth of drive. When the shoe 50 is adjusted relative to the depth of drive adjustment element 30 so that a lower end of the depth of drive adjustment element is relatively low or close to the foot pad 56 (FIG. 3), the fastener is more deeply driven than when the shoe. 50 is adjusted to be relatively higher relative to the depth of drive adjustment element 30 (FIG. 5). An interim or flush position is shown in FIG. 4, wherein the fastener head is driven to be flush with the workpiece. It is contemplated that in some applications, the shoe 50 may be eliminated or integrally incorporated into the depth of drive adjustment element 30.

To maintain the shoe 50 in a selected position relative to the depth of drive adjustment element 30, a locking device 62 is provided. Preferably the locking device 62 is configured for releasably retaining the shoe 50 in a desired position, and is provided with a biased locking element 64, such as a spring ball. As is well known in the art, the element 64 is retained in a throughbore 66 in the body 52. A biasing element 68 such as a spring is held in the throughbore 66 between a spring ball adapter 70 and a disk-like cap 72. The locking element 64 projects under the force of the biasing element 68 partially through a ball aperture 74, which has a smaller diameter than the ball 64 to prevent the escape of the ball from the throughbore 66. To properly seat the ball 64, the threaded exterior 46 of the depth of drive adjustment element 30 is provided with at least one and preferably a plurality of spaced threadless flat spots or detents 76.

Referring now to FIGS. 2 and 7, while the shape of the shoe 50 may vary, it preferably has a relatively larger portion 78 and a relatively smaller sight portion 80. The larger portion 78 is configured as such for dissipating the operational shock impacts through the substrate. Conversely, the sight portion 80 is designed to facilitate the user's view of the substrate and specifically the fastener driving location. As such, the sight portion 80 is preferably provided with an aiming notch 82 for enhancing visibility.

Figure 6:
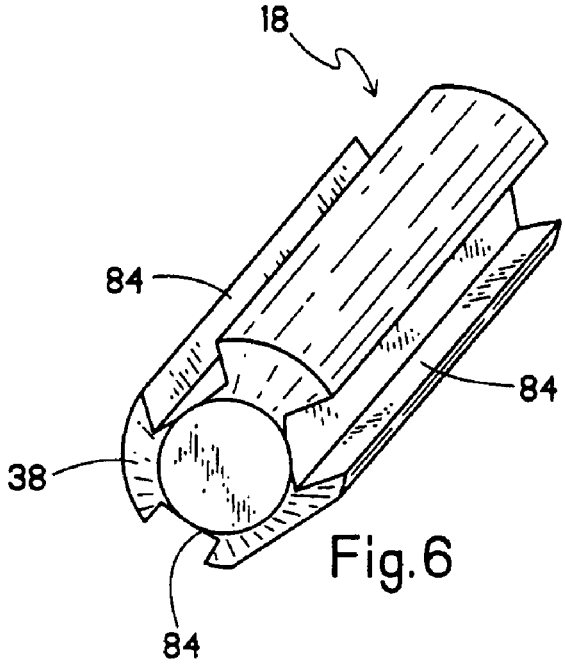
FIG. 6 is a perspective view of the present driver blade.

Referring now to FIGS. 6 and 7, the driver blade 18 is preferably provided with at least one and preferably a plurality of longitudinal guides 84 which are basically channels cut into the sides of the blade and extend axially almost the full length of the driver blade. The guides 84 are matingly and slidably received by complementary ribs 86 projecting radially into the fastener passageway 24. This guiding relationship maintains alignment of the driver blade 18 in the passageway 24, prevents misaligned fasteners and provides increased fastener control.

Thus, it will be seen that the present depth of drive apparatus, including the depth of drive adjustment element 30 and the shoe 50, are specially designed to absorb and dissipate shock loads generated by the reciprocating driver blade 18. Also, the configuration of the shoe 50 enhances shock force transmission to the substrate while providing a sight portion for enhancing accurate fastener placement. Lastly, the ribs 86 on the nosepiece 20 facilitate fastener control.

While a particular embodiment of the present depth of drive with load transfer for fastener driver has been shown and described, it will be appreciated by those skilled in the art that changes and modifications may be made thereto without departing from the invention in its broader aspects and as set forth in the following claims.

What is claimed is:

1. In a fastener driving tool with a nosepiece defining a fastener passageway, a driver blade reciprocating in the passageway for driving fasteners sequentially fed from a magazine into a workpiece, a depth of drive apparatus, comprising:

a depth of drive adjustment element being reciprocally movable relative to an end of the nosepiece, said depth of drive adjustment element defining a nosepiece chamber dimensioned for receiving the nosepiece and including a driver blade stop configured for receiving an end of the driver blade to terminate vertical driving motion of the driver blade.

2. The apparatus of claim 1 further including a shoe mounted to said depth of drive adjustment element for adjustment relative thereto for adjusting the depth of drive.

3. The apparatus of claim 2 wherein said depth of drive adjustment element has a threaded exterior, and said shoe is provided with a threaded bore for adjustably engaging said depth of drive adjustment.

4. The apparatus of claim 3 further including a locking device for releasably retaining said shoe in position relative to said depth of drive adjustment element.

5. The apparatus of claim 4 wherein said locking device is a spring ball engaging detents in said threaded exterior.

6. The apparatus of claim 2 wherein said shoe is provided with a foot configured for engaging a substrate and for transmitting shock loads to the substrate.

7. The apparatus of claim 6 wherein said foot is provided with a sight portion constructed and arranged for facilitating user visibility of the workpiece.

8. The apparatus of claim 6 wherein said foot is provided on an underside with a resilient pad for dampening shock impact generated by fastener driving.

9. The apparatus of claim 1 wherein said depth of drive adjustment element is configured to directly receive the end of the driver blade.

10. The apparatus of claim 9 wherein the driver blade end is tapered, and said driver blade stop is provided with a complementary taper for receiving the driver blade.

11. A fastener driving tool, comprising:

a driver blade having a body with at least one longitudinal guide formation and a tapered driving end;

a nosepiece defining a fastener passageway and configured for reciprocally receiving said driver blade, said passageway having at least one complementary rib slidably engaging said at least one guide formation; and a depth of drive adjustment element being reciprocally movable relative to an end of said nosepiece, said depth of drive adjustment element defining a nosepiece chamber dimensioned for slidably receiving said nosepiece and including a driver blade stop configured for receiving said driver blade end to terminate vertical driving motion of the driver blade.

12. The tool of claim 11 wherein said driver blade end is tapered and said driver blade stop is complementary tapered for receiving said driver blade end.

13. The tool of claim 11 further including a shoe mounted to said depth of drive adjustment element for adjustment relative thereto for adjusting the depth of drive.

14. The tool of claim 13 wherein said depth of drive adjustment element has a threaded exterior and said shoe is threadably adjustable relative to said exterior for adjusting a depth of drive of said tool.

15. The tool of claim 13 wherein said shoe has a foot constructed and arranged for engaging a substrate, said foot including a sight portion for facilitating user visibility of the workpiece.

16. The tool of claim 15 wherein said sight portion includes an aiming notch for locating a fastener driving location on the workpiece.

17. The tool of claim 13 further including a locking device for releasably retaining said shoe in position relative to said nosepiece.

18. A fastener driving tool, comprising:

a driver blade having a body with at least one longitudinal guide formation and a tapered driving end;

a nosepiece defining a fastener passageway and configured for reciprocally receiving said driver blade, said passageway having at least one complementary rib slidably engaging said at least one guide formation;

a depth of drive adjustment element being reciprocally movable relative to an end of the nosepiece, said depth of drive adjustment element defining a nosepiece chamber dimensioned for receiving the nosepiece and including a driver blade stop configured for receiving said driver blade end to terminate vertical driving motion of the driver blade; and a shoe mounted to said workpiece contact element for adjustment relative thereto for adjusting the depth of drive, said shoe provided with a foot dimensioned for engaging the workpiece and a sight portion for facilitating visibility of the workpiece and locating a fastener driving location.

19. The tool of claim 18 further including a locking device for releasably retaining said shoe in relation to said nosepiece, said device exerting a biasing force upon an exterior of said nosepiece.

20. The tool of claim 18 further including a resilient pad secured to a lower end of said foot for dampening shock impacts generated by fastener driving by said tool.

* * * * *